US010626875B2

(12) United States Patent
Ahuja

(10) Patent No.: US 10,626,875 B2
(45) Date of Patent: Apr. 21, 2020

(54) PORTABLE WRIST FAN

(71) Applicant: Shreya Ahuja, Mansfield, MA (US)

(72) Inventor: Shreya Ahuja, Mansfield, MA (US)

( * ) Notice: Subject to any disclaimer, the term of this patent is extended or adjusted under 35 U.S.C. 154(b) by 201 days.

(21) Appl. No.: 15/822,335

(22) Filed: Nov. 27, 2017

(65) Prior Publication Data

US 2019/0162196 A1 May 30, 2019

(51) Int. Cl.

| | |
|---|---|
| ***F04D 25/08*** | (2006.01) |
| ***F04D 25/06*** | (2006.01) |
| ***F04D 29/32*** | (2006.01) |
| ***F04D 29/38*** | (2006.01) |
| ***F04D 19/00*** | (2006.01) |

(52) U.S. Cl.

CPC ..... *F04D 25/084* (2013.01); *F04D 19/002* (2013.01); *F04D 25/06* (2013.01); *F04D 29/325* (2013.01); *F04D 29/388* (2013.01)

(58) Field of Classification Search

CPC .... F04D 29/388; F04D 29/325; F04D 25/086; F04D 25/084; F04D 25/0673; F04D 25/06; F04D 19/002

See application file for complete search history.

(56) References Cited

U.S. PATENT DOCUMENTS

| | | | | |
|---|---|---|---|---|
| 6,409,475 | B1 * | 6/2002 | Ho | F04D 25/06 248/314 |
| 6,454,539 | B1 * | 9/2002 | Santos | F04D 25/084 416/63 |
| 6,464,468 | B2 | 10/2002 | Colburn | |
| 7,017,871 | B2 * | 3/2006 | Chen | F04D 29/601 248/161 |
| 10,125,778 | B1 * | 11/2018 | Harris | F24C 15/2092 |
| 2004/0062661 | A1 * | 4/2004 | Hajdasz | F04D 25/084 417/234 |
| 2017/0198703 | A1 * | 7/2017 | Leitman | F04D 25/084 |

FOREIGN PATENT DOCUMENTS

| | | | | |
|---|---|---|---|---|
| CN | 202012487 U | 10/2011 | | |
| CN | 102367804 | 3/2012 | | |
| CN | 202971253 U | 6/2013 | | |
| CN | 203101845 U | 7/2013 | | |
| WO | WO-2016086273 A1 * | 6/2016 | | F04D 25/084 |

* cited by examiner

*Primary Examiner* — Kenneth Bomberg
*Assistant Examiner* — Julian B Getachew
(74) *Attorney, Agent, or Firm* — MDIP LLC

(57) ABSTRACT

A wrist fan assembly comprises a band, a bendable telescopic rod and a fan housing. The telescopic rod is attached to the band and the fan housing at each end and provides adjusting means to the fan. The fan housing includes propeller assembly having foam blades and motor connected to the power source. The wrist fan assembly is lightweight and comfortable for daily use.

18 Claims, 4 Drawing Sheets

PORTABLE WRIST FAN

FIELD OF INVENTION

The present invention relates to a portable wrist fan wearable by a user which is light weight, portable, and provides adjustable heights and rotational angles to the fan for direct access of the air breeze to the user.

BACKGROUND

Portable fans provide a convenient and quick cooling effect to the user in a sultry environment. Portable fans vary in shapes, sizes and the amount of cooling effect they provide. These fans are wearable on the user's body like on hand, arm, head and can also be carried by the user. Cooling devices comes with various applications and according to that their size and assembly varies. The different application and uses of fans presents various designs and modifications such as if high wind speeds are required than the diameter and sweep angle of the fan blades is made larger. Hence, different fans like fan with canopy assembly, arm fans, barbecue fan etc. differ in their shape and sizes according to their function.

Portable wrist fans are generally made from plastic or metal, and include battery powered propeller assembly affixable to the hand using any plastic band or straps. These are provided with the simple structural assembly to be convenient for the user. There are many drawbacks associated with the wrist fans such as their metallic body makes its structure heavy and the metallic cage for the propeller gets very hot in the sun. These wrist fans are either too small or too large, making these fans undesirable for use. Few devices have elbow like connection made up of plastic between fan and wrist band which is prone to get stuck or jam many times. While using the wrist fan the user must move his hand around his face for direct flow of air which is a tiring job in case the fan is used for long durations.

With respect to the existing portable wrist fan devices, there exists a need for a customized fashion of the wrist fan, which is comfortable, lightweight and provides maneuvering means to adjust the height and angle of rotation of the fan. A portable fan is required which can be adjusted at different heights elevated from the wrist, so that user can feel the cool breeze without disturbing his hand position; and the provision of such an arrangement is the stated objective of the present invention.

SUMMARY

The present invention provides an improved wrist fan assembly which further includes maneuvering means associated therewith, such that the fan assembly can be adjusted to different heights and angles according to the user's requirements.

As will be hereinafter described, embodiments of the fan assembly of the present invention comprises a fan housing, a bendable telescopic rod and a band. Fan housing contemplates a plurality of lightweight foam fan blades affixed preferably to the one end of the telescopic rod. The telescopic rod, which can be bent, retracted and expanded by the user provides different heights and angles to the fan housing. On the other end of the telescopic rod, it is attached to the band which holds the fan assembly on the user's wrist.

The fan is powered by a solar power source, made from soft plastic which reduced the manufacturing cost of the fan.

Maneuvering means of the fan assembly are made up of metal to prevent jamming and streaking of the joints.

Wrist fan assembly of the present invention is designed to be adjusted in different angles and at different heights. The fan housing can be rotatable in three degrees of freedom so that it can provide current of air in any direction without changing the hand position.

Furthermore, the present invention has greater portability and usability since the wrist fan assembly is light weighted, so it can be worn for longer time duration without any discomfort.

BRIEF DESCRIPTION OF THE DRAWINGS

The objectives and advantages of the present invention will become apparent from a detailed description provided below, with reference to the accompanying drawings wherein.

DETAILED DESCRIPTION

The present invention and the various features and advantageous details thereof are explained more fully with reference to the non-limiting embodiments described in detail in the following description.

Figure 1:
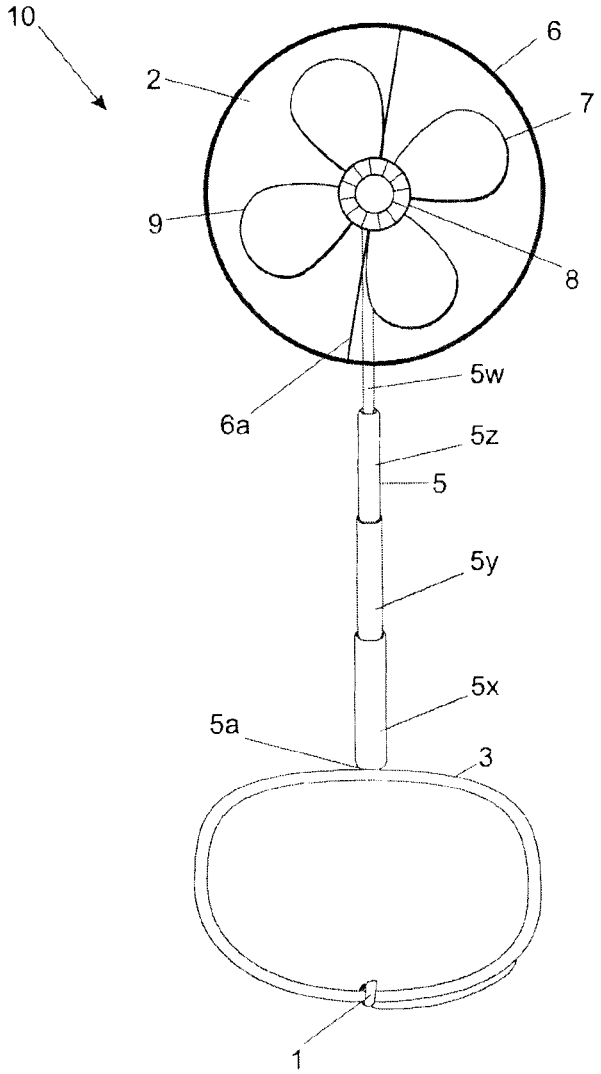
FIG. 1 is a front view of a wrist fan assembly of the present invention.

Referring to FIG. 1, an embodiment of a wrist fan according to present invention is shown. The wrist fan assembly 10 comprises a band 3, having an adjustable buckle 1 for loosening or tightening of the band around the wrist. A bendable telescopic rod 5 which has four hollow segments 5*x*,5*y*,5*z* and 5*w* with different diameters connected to each other, preferably constructed out of metal to prevent the streaking and jamming of the rod and is fixedly attached to the band 3 at a first end 5*a* and connected to the fan housing 2 on a second end (not shown) using an interconnecting means which is described in further embodiments. The telescopic structure of the rod 5 provides the advantage of adjusting the length of the fan assembly 10 to make it closer to the face of the user while increasing the cooling effects of the fan.

In an embodiment of the present invention, all the segments 5*x*,5*y*,5*z* and 5*w* of the telescopic rod 5 are flexible and bendable to provide angular orientation to the fan assembly 10.

In another embodiment of the present invention, there could be particular cross-sectional portion of each segment 5*x*,5*y*,5*z* and 5*w* of telescopic rod 5, which is made up of bendable material to provide bending structure to the telescopic rod 5.

Fan housing 2 of the present invention is preferably constructed of a durable soft plastic or the like to provide a light weight structure to the wrist fan 10. This lightweight structure of the wrist fan 10, makes it more feasible to use and to wear it on for longer time duration. The fan housing 2 includes a propeller 8, which has circumferential rim 6 lined with foam around it. The sharp edges of the blade or rim of fans available in the market can hurt or make scratches to the user or anyone coming in contact with so herein the foam lining makes the sharp edges, soft and smooth. In another embodiment, the fan housing 2 can be without a rim 6.

In another embodiment of the present invention, the telescopic rod 5 is attached to the band 3 using an articulating member with locking means so that user can lock the wrist fan assembly 10, in any particular direction as per the requirement.

Figure 2:
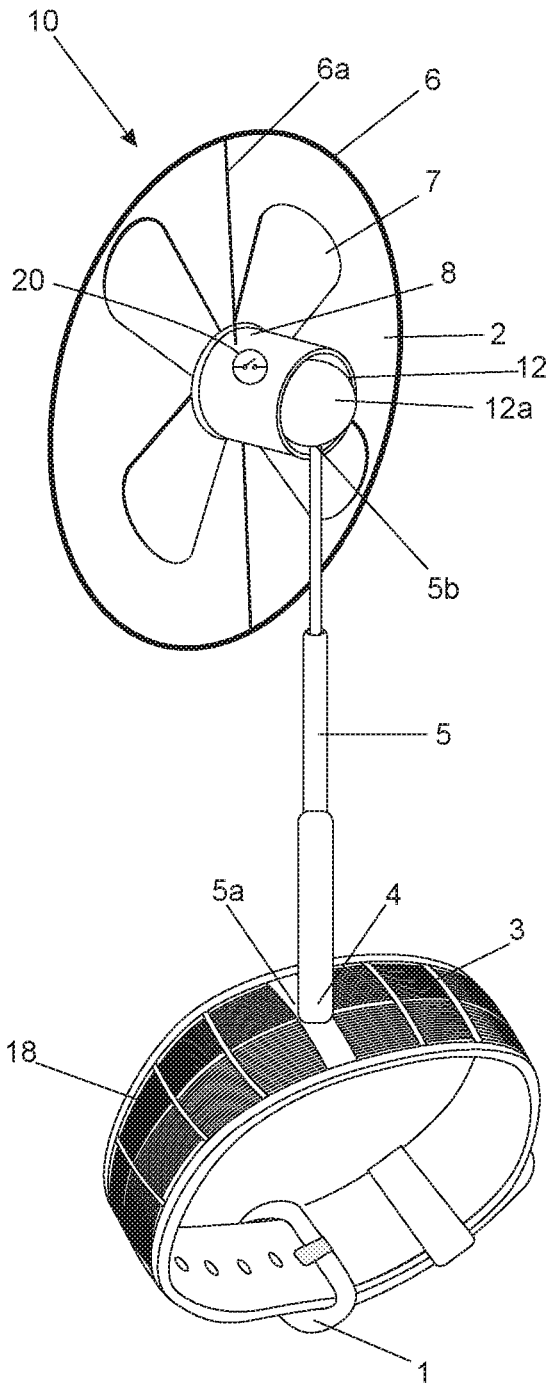
FIG. 2 is a rear view of a wrist fan assembly of the present invention.

Referring to FIG. 2, the present invention provides a wrist fan assembly 10, comprises a leather band 3, herein leather is preferred to make band 3 of the wrist fan assembly 10, as it makes the band more comfortable to wear and aesthetic in appearance. The advantage of using leather as the band material over other materials such as plastic is that most of the plastic bands are stiff and become sticky and unbreathable to the skin of the user. The leather band 3, which has an adjusting buckle 1 for its loosening or tightening around the user's wrist is more comfortable. The band 3 is attached to the telescopic rod 5 using a fixed joint.

Telescopic rod 5 at second end 5*b* is connected to a fan housing 2 using an interconnecting means 12, which is a ball joint 12*a*. The ball joint 12*a* provides three degree of rotational freedom to the Fan housing 2, which are Yaw, Pitch and Roll. This rotational freedom facilitates the user to adjust the face of the fan housing 2 according to their comfort or choice.

The telescopic rod 5 is a bendable, retractable and expandable rod which provides various height and angular adjustments to the fan housing 2. This feature of the wrist fan assembly 10 of the present invention makes this wrist fan assembly unique as user can fix the height and angle of the fan assembly 10, as per their requirement.

In daily life situations people require a fan or cooling device which has various maneuvering options to cool them off. Using this telescopic rod 5 user can bring the fan housing 2 closer to self without changing the position of his hand. For example, a user sitting in a classroom, traveling in a bus or train, or standing at a bus stop; in each of these cases user's hand is located in different proximities to the face, therefore using different height and rotational adjustments user can comfort himself without disturbing the existing hand position.

Fan housing 2 includes a rim 6, preferably made up of foam encompassing a propeller assembly 8. Rim 6 is supported by two or more spokes from the center of the fan housing 2.

Motor (not shown) to drive the propeller 8 is electrically connected to the power source (not shown). The power source used can be an electric battery or a solar powered battery wherein small solar power strips 18 (shown in FIG. 2) can be located/placed on the band 3. It can be recharged anywhere, anytime when the user is in contact with sun.

In another embodiment of the present invention there can be a small portable solar panel (not shown) along with the wrist fan assembly 10 which can be used to recharge the battery or to provide direct power to the fan motor.

In yet another embodiment, the telescopic rod 5 includes an Universal Serial Bus (USB) port (not shown) at its first end 5*a*. USB connector provides the fan assembly 10 to communicate with other devices for example laptop, computer system, mobile phone, solar panel and other electronic devices.

In another embodiment of the invention, motor and the battery of the fan assembly 10 are disposed inside the propeller compartments.

Wrist fan assembly 10 comprises a power switch 20 for activating the motor to rotate the propeller 8. Wrist fan assembly 10, also comprises a control means (not shown) to control the speed of the propeller 8.

In yet another embodiment, wrist fan assembly 10 comprises an integrated unit (not shown) which serves the purpose for both the power switch and the control means.

The power switch, the control means and the integrated unit can be located anywhere on the fan housing 2.

In yet another embodiment, wrist fan 10 comprises sensors (not shown) to measure user's physiological parameters like temperature, blood pressure etc. which indirectly controls the power switch 20 and speed of the fan according to the readings taken by the sensors. The band 3 has a small screen (not shown) for the display of the readings taken by the sensors.

In yet another embodiment, wrist fan 10 comprises environmental sensors (not shown) to measure the surroundings state like temperature, humidity, pressure etc. The sensor will automatically control the power switch 20 and speed of the wrist fan assembly 10.

Yet another embodiment of the present invention provides a wrist fan assembly 10 for accessing and controlling services in a network from a remote location. Wrist fan 10 can be IOT (internet of things) enabled to wirelessly communicate with other devices. Readings from the sensors mentioned in one of the previous embodiments of the present invention use internet of things (IOT) to communicate with the external devices (for example: a mobile phone), which has a mobile application to control different operations of the fan assembly 10.

In yet another embodiment, wrist fan assembly 10 comprises a leather band 3, which has a timepiece unit (not shown) attached on it.

Figure 3:
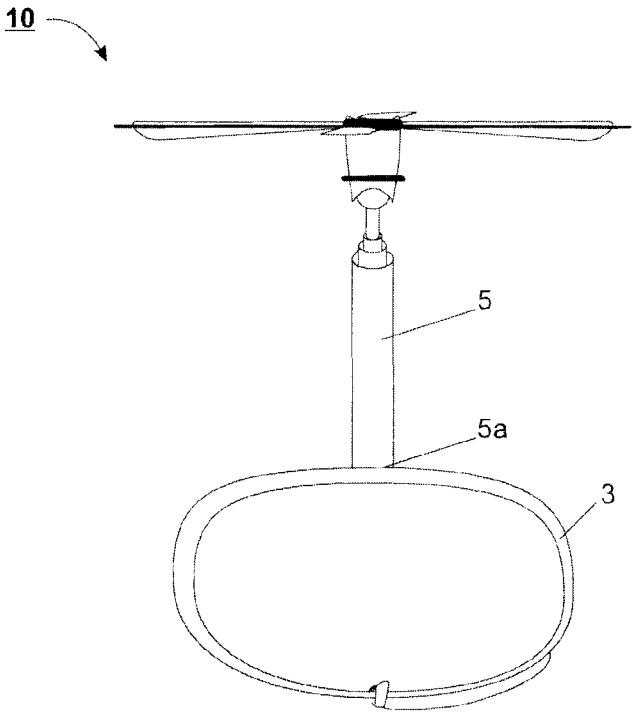
FIG. 3 is a wrist fan assembly in a retracted position when telescopic rod is fixedly connected to a band of the invention.

Referring to FIG. 3, the present invention provides a wrist fan assembly 10, comprises a leather band 3, a telescopic rod 5 in a vertically retracted state fixedly attached to the band 3 at first end 5*a*.

Figure 4:
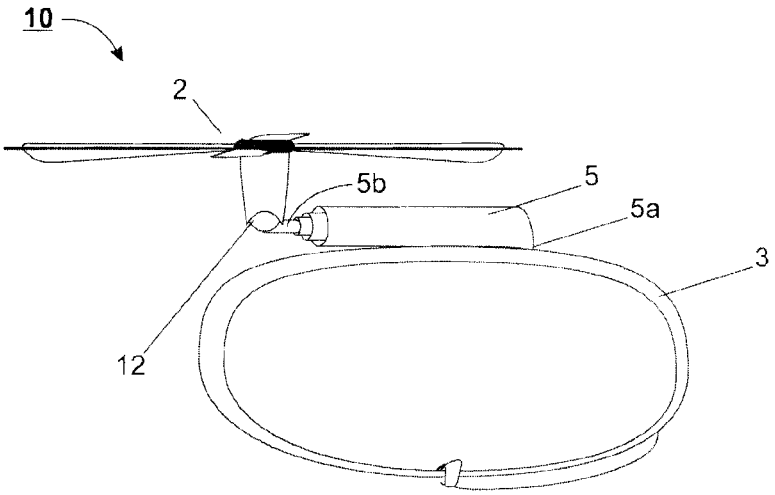
FIG. 4 is a wrist fan assembly in a retracted position when telescopic rod is in bent state.

Referring to FIG. 4, the present invention provides a wrist fan assembly 10, comprising a leather band 3, a bendable telescopic rod 5 which is fixedly attached to the band 3 at first end 5*a* and the second end 5*b* is attached to the fan housing 2 using an interconnecting means 12. At the first end 5*a*, the bendable telescopic rod is providing a holdable bent position to the fan so as to get the most collapsed and compact state of the fan assembly 10.

In another embodiment, bendable telescopic rod 5 is used to adjust the fan housing 2 in any feasible direction as per the user's convenience. The bending feature of the telescopic rod 5 is to hold the fan assembly 10 at any angular orientation.

Figure 5:
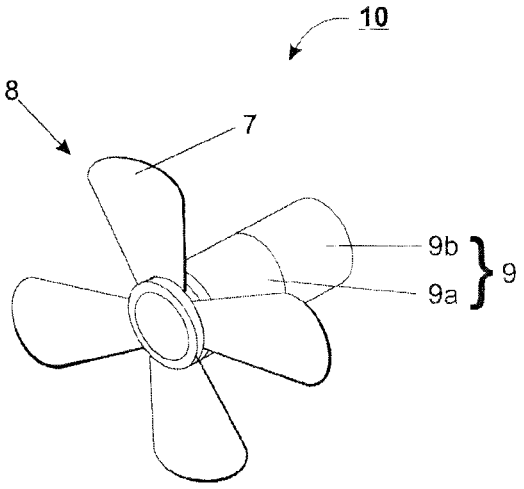
FIG. 5 is a sectional view of the propeller assembly.

Referring to FIG. 5, a propeller 8 of the wrist fan assembly 10 is shown which is made up of plastic and comprises foam blades 7 to give it a lightweight structure. The propeller 8 has a motor (not shown) contained in a compartment 9.

In another embodiment, compartment 9 can be divided into first compartment 9*a* and second compartment 9*b* which can be utilized for both the power source (not shown) and the motor (not shown) storage.

Figure 6:
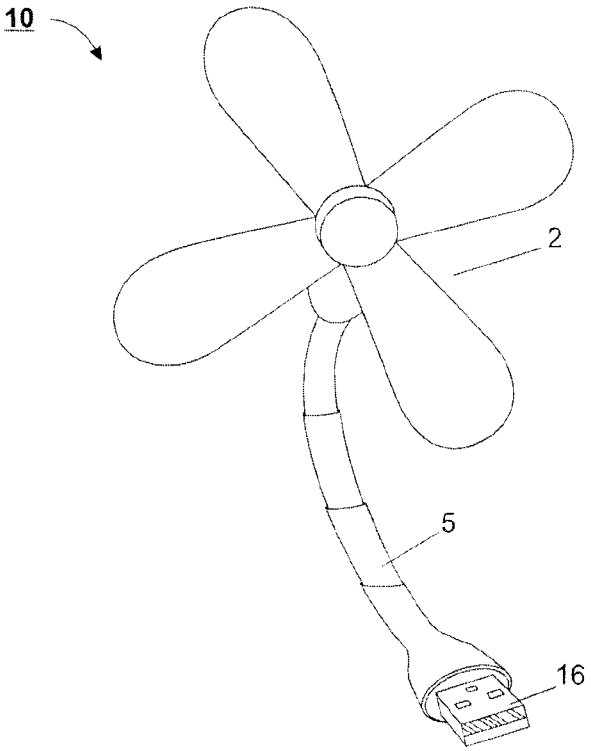
FIG. 6 is a perspective view of the fan assembly having an USB port at one end of telescopic rod.

Referring to FIG. 6, the present invention provides a fan assembly 10, comprising an bendable telescopic rod 5 attached to fan housing 2 at one end via an articulating member (not shown) and has an USB port 16 at another end.

USB port is used to connect the fan assembly to other electronic devices, for charging, sharing data, controlling operations of the fan or the like.

Thus, an advantage of the present invention is that the plastic body of the fan assembly and bendable telescopic rod provides it a simple, light weight and compact structure, which is easy to handle and carry by the user. Another advantage of the present invention is that there would be minimum energy demand to operate the fan, which makes it cost effective. Other advantages of the invention will in part be apparent from the specifications.

Although the description above contains many specifications, these should not be construed as limiting the scope of the invention but merely providing illustrations of some of the presently preferred embodiments of this invention.

With respect to the above description and by reference to specific embodiments thereof, it will be apparent and obvious to those skilled in the art, that many modifications and variations are possible in the above mentioned embodiments without departing from the scope of the embodiments defined in the appended claims.

What is claimed is:

1. A wrist fan assembly comprising:

a band;

a fan housing comprising a propeller driven by a motor, wherein the motor is powered by a power source;

a bendable, hollow telescopic rod having a first end fixedly attached to the band and a second end connected to the fan housing using a ball joint, wherein the ball joint provides three degrees of rotational freedom as roll, pitch, yaw to the fan housing, and wherein the telescopic rod is bendable at one or more portions between the first end and the second end; and a power switch electrically connected to the motor for activating the propeller.

2. The wrist fan assembly of claim 1, wherein the telescopic rod is attached to the band using a lock that locks the wrist fan assembly in one or more directions.

3. The wrist fan assembly of claim 1, wherein the band has a plurality of holes and a buckle for tightening or loosening of the band around a wrist of a user.

4. The wrist fan assembly of claim 1, wherein the fan housing has a circumferential rim around the propeller.

5. The wrist fan assembly of claim 4, wherein the rim is lined with a foam.

6. The wrist fan assembly of claim 1, wherein the propeller comprises foam blades.

7. The wrist fan assembly of claim 1, wherein the power source comprises a solar powered battery.

8. The wrist fan assembly of claim 1, wherein the telescopic rod comprises a metal.

9. The wrist fan assembly of claim 1, wherein the power switch is manually operated or automatically controlled.

10. The wrist fan assembly of claim 1, wherein the wrist fan assembly communicates with one or more external devices.

11. A wrist fan assembly comprising:

a band;

a propeller driven by a motor contained in a first compartment, wherein the motor is powered by a power source contained in a second compartment;

a bendable, hollow telescopic rod having a first end attached to the band and a second end connected to the propeller using a ball joint permitting a user to adjust the propeller along a vertical and/or a horizontal plane, wherein the telescopic rod is bendable at one or more portions between the first end and the second end; and a power switch electrically connected to the motor for activating the propeller.

12. The wrist fan assembly of claim 11, wherein the telescopic rod is attached to the band using a lock that locks the wrist fan assembly in one or more directions.

13. The wrist fan assembly of claim 11, wherein the band has a plurality of holes and a buckle for tightening or loosening of the band around a wrist of the user.

14. The wrist fan assembly of claim 11, wherein the propeller comprises foam blades.

15. The wrist fan assembly of claim 11, wherein the motor and the power source are contained in a single compartment including the first compartment and the second compartment.

16. The wrist fan assembly of claim 11, wherein the power source comprises a solar powered battery.

17. The wrist fan assembly of claim 11, wherein the telescopic rod comprises a metal.

18. The wrist fan assembly of claim 11, wherein the telescopic rod comprises a USB port at the first end.

* * * * *